US007981330B2

(12) United States Patent
Jensen

(10) Patent No.: US 7,981,330 B2
(45) Date of Patent: Jul. 19, 2011

(54) FORM ASSEMBLY FOR USE IN CONSTRUCTING PIER PADS

(76) Inventor: Dan Jensen, Tacoma, WA (US)

( * ) Notice: Subject to any disclaimer, the term of this patent is extended or adjusted under 35 U.S.C. 154(b) by 155 days.

(21) Appl. No.: 11/895,028

(22) Filed: Aug. 21, 2007

(65) Prior Publication Data

US 2008/0084001 A1 Apr. 10, 2008

Related U.S. Application Data

(60) Provisional application No. 60/839,355, filed on Aug. 21, 2006, provisional application No. 60/921,888, filed on Apr. 4, 2007.

(51) Int. Cl.

| | |
|---|---|
| ***E04B 1/16*** | (2006.01) |
| ***B29C 45/76*** | (2006.01) |
| ***E04G 13/02*** | (2006.01) |
| ***B28B 7/02*** | (2006.01) |
| ***B41B 11/60*** | (2006.01) |

(52) U.S. Cl. ..... 264/31; 264/40.1; 249/49; 249/157

(58) Field of Classification Search ..... 264/31, 264/40.1; 249/49, 157

See application file for complete search history.

(56) References Cited

U.S. PATENT DOCUMENTS

| | | | | |
|---|---|---|---|---|
| 1,300,393 | A | 4/1919 | Hodges | |
| 3,109,361 | A | 11/1963 | Nicoli | |
| 3,956,437 | A | 5/1976 | Ellis | |
| 5,658,597 | A | 8/1997 | Breidenstein et al. | |
| 5,706,558 | A * | 1/1998 | Sauer | 24/279 |
| 6,513,291 | B2 * | 2/2003 | Gilsdorf | 52/297 |
| 7,243,897 | B2 | 7/2007 | Huber et al. | |
| 7,290,750 | B2 | 11/2007 | Huber et al. | |
| 2003/0222368 | A1 | 12/2003 | Gilmour | |
| 2004/0093824 | A1 | 5/2004 | Huber et al. | |
| 2005/0138778 | A1 * | 6/2005 | Oetiker et al. | 24/20 R |
| 2007/0193192 | A1 | 8/2007 | Huber | |

* cited by examiner

*Primary Examiner* — Khanh Nguyen
*Assistant Examiner* — Matthew Hoover
(74) *Attorney, Agent, or Firm* — Seed Intellectual Property Law Group PLLC

(57) ABSTRACT

Form assemblies disclosed herein include a form assembly having a reusable flexible form. The form can define a molding cavity having a shape corresponding to the shape of a pier pad. The form assembly can selectively adjust the size and shape of the cavity such that different types of pier pads can be formed with a single form assembly. A user can determine the shape and configuration of the form based using a table relating pier pads of a first shape to pier pads of a second different shape.

20 Claims, 13 Drawing Sheets

107 104

* = OTHER PIER STRIP A
# = OTHER PIER STRIP B
D = DIAMETER
□ = SQUARE
C = CIRCUMFERENCE

| Line | Size | | Matrix | Circumference | Diameter | Area | # of piers per cubic yard 8" | 10" |
|---|---|---|---|---|---|---|---|---|
| 1 | 12" | D = | AB6 | 37 11/16 | 12" | 113.04 | 51.5 | 41.2 |
| 2 | 12" | □ = | B1# B4# | 42 1/2 | 13 9/16 | 144 | 40.5 | 32.4 |
| 3 | 18" | D = | AB4 | 56 1/2 | 18" | 254.34 | 22.9 | 18.3 |
| 4 | 18" | □ = | AB3 | 63 13/16 | 20 5/16 | 324 | 18 | 14.4 |
| 5 | 24" | D = | AB2 | 75 5/16 | 24" | 452.16 | 12.89 | 10.3 |
| 6 | 24" | □ = | AB1 | 85 1/16 | 27 1/8 | 576 | 10.1 | 8.1 |
| 7 | 30" | D = | B5* B5* | 94 3/16 | 30" | 706.50 | 8.25 | 6.6 |
| 8 | 30" | □ = | B6# B6# | 106 5/16 | 33 7/8 | 900 | 6.48 | 5.18 |
| 9 | 36" | D = | B4* B4* | 113 1/16 | 36" | 1017.36 | 5.73 | 4.58 |
| 10 | 36" | □ = | B3* B3* | 127 9/16 | 40 5/8 | 1296 | 4.5 | 3.6 |
| 11 | 42" | D = | B4* B2* | 131 7/8 | 42" | 1384.74 | 4.2 | 3.37 |
| 12 | 42" | □ = | B3* B1* | 148 7/8 | 47 3/8 | 1764 | 3.3 | 2.64 |
| 13 | 48" | D = | B2* B2* | 150 11/16 | 48" | 1808.64 | 3.2 | 2.58 |
| 14 | 48" | □ = | B1* B1* | 170 1/8 | 54 3/16 | 2304 | 2.53 | 2.02 |

NOTE

ALL SQUARE SIZES ARE CONVERTED TO A CIRCULAR CONFIGURATION MAINTAINING THE SQUARE DISPLACEMENT.

ALL PIER SIZES ARE APPROXIMATELY + OR - 1/4 INCH. VERIFY DIMENSIONS ARE SUITABLE BEFORE POURING.

FIG. 11A 107 104

* = OTHER PIER STRIP A
# = OTHER PIER STRIP B
D = DIAMETER
□ = SQUARE
C = CIRCUMFERENCE

| Line | Size | | Matrix | Circumference | Diameter | Area | # of piers per cubic yard 8" | 10" |
|---|---|---|---|---|---|---|---|---|
| 1 | 12" | D = | A1* A4* | 37 11/16 | 12" | 113.04 | 51.5 | 41.2 |
| 2 | 12" | □ = | A2* 1A4* | 42 1/2 | 13 9/16 | 144 | 40.5 | 32.4 |
| 3 | 18" | D = | AB4 | 56 1/2 | 18" | 254.34 | 22.9 | 18.3 |
| 4 | 18" | □ = | AB3 | 63 13/16 | 20 5/16 | 324 | 18 | 14.4 |
| 5 | 24" | D = | AB2 | 75 5/16 | 24" | 452.16 | 12.89 | 10.3 |
| 6 | 24" | □ = | AB1 | 85 1/16 | 27 1/8 | 576 | 10.1 | 8.1 |
| 7 | 30" | D = | B2* 2A4* | 94 3/16 | 30" | 706.50 | 8.25 | 6.6 |
| 8 | 30" | □ = | B1# 3B1* | 106 5/16 | 33 7/8 | 900 | 6.48 | 5.18 |
| 9 | 36" | D = | B4* B4* | 113 1/16 | 36" | 1017.36 | 5.73 | 4.58 |
| 10 | 36" | □ = | B3* B3* | 127 9/16 | 40 5/8 | 1296 | 4.5 | 3.6 |
| 11 | 42" | D = | B2* B4* | 131 7/8 | 42" | 1384.74 | 4.2 | 3.37 |
| 12 | 42" | □ = | B1* B3* | 148 7/8 | 47 3/8 | 1764 | 3.3 | 2.64 |
| 13 | 48" | D = | B2* B2* | 150 11/16 | 48" | 1808.64 | 3.2 | 2.58 |
| 14 | 48" | □ = | B1* B1* | 170 1/8 | 54 3/16 | 2304 | 2.53 | 2.02 |

NOTE

ALL SQUARE SIZES ARE CONVERTED TO A CIRCULAR CONFIGURATION MAINTAINING THE SQUARE DISPLACEMENT.

ALL PIER SIZES ARE APPROXIMATELY + OR - 1/4 INCH. VERIFY DIMENSIONS ARE SUITABLE BEFORE POURING.

FIG. 11B

FORM ASSEMBLY FOR USE IN CONSTRUCTING PIER PADS

CROSS-REFERENCES TO RELATED APPLICATIONS

This application claims the benefit under 35 U.S.C. §119 (e) of U.S. Provisional Patent Application No. 60/839,355 filed Aug. 21, 2006; and U.S. Provisional Patent Application No. 60/921,888 filed Apr. 4, 2007, where these two provisional applications are incorporated herein by reference in their entireties.

BACKGROUND

1. Field of the Disclosure

The present disclosure generally relates to form assemblies for use in constructing building structures, and more specifically to form assemblies for use in constructing concrete pier pads.

2. Background

Building structures, such as residential dwellings, often have structural posts or columns that hold support beams. For example, vertically oriented posts are often installed in basements, crawl spaces, and other areas to support horizontal beams, which in turn provide support for overlying portions of the structure. As such, significant loads may be applied to these posts. In order to provide a stable footing for such posts and to prevent moisture, frost, and other forces from displacing them, the posts are typically installed on concrete pads, commonly referred to as pier pads.

BRIEF SUMMARY

Form assemblies described herein can be used to make various types of structural members. As used herein, the term "structural member" is a broad term that may include, without limitation, a pier pad, footing, portion of a foundation, column, slab, and the like. The form assemblies are disclosed in the context of making pier pads because they have particular utility in this context. However, the form assemblies can be used to produce other types of structural members.

Some embodiments disclosed herein include the realization that a form assembly can have a reusable flexible form. The form can define a molding cavity having a shape corresponding to the shape of a pier pad. The form assembly can selectively adjust the size and shape of the cavity such that different types of pier pads can be formed with a single form assembly.

In some embodiments, a form assembly includes a pin that is inserted through slots in the form to set the form in a desired position. The form can have an array of slots positioned along the length of the form. The pin can be positioned in different slots to form molding cavities of different sizes. Moldable material can be delivered into the cavity. When the moldable material has set, the pin can be removed from the slots for convenient removal of the form. The form can then be reused to form more structures. The slots in some embodiments can be perforations (e.g., removable or non-removable perforations), opened ended openings, closed ended openings, and the like. In some embodiments, the form can have foldable tabs that can be folded outwardly or inwardly to form openings or slots. Unfolded tabs can provide molding surfaces that prevent leaking of molding material.

The form in some embodiments can comprise a material suitable for retention on the molded structure. For example, the form can comprise mostly or entirely a non-biodegradable material. The form can be left on the molded structure indefinitely. The form may help maintain the structural integrity of the structure.

In one embodiment, the form is an elongate strip made of a flexible material, such as corrugated polypropylene, and is approximately one-quarter inch thick. A first pair of perforated slots is located near one end of the strip. Additional pairs of perforated slots are positioned along the length of the strip so as to allow forming of cavities of desired sizes, such as, for example, circular cavities of desired sizes. The form can be a generally rectangular strip. Other configurations are possible.

In use, the strip in some embodiments can be rolled into a circle of a desired size and a coupling member (e.g., a pin) inserted into the slots to hold the strip together in a circular form. For example, the strip may be rolled so that the first pair of slots lines up with the second pair of slots to form a circle of a desired size, such as a circle with a diameter of approximately 24 inches, 36 inches, or 48 inches. Other shapes and dimensions are also possible. Moldable material can be poured into the cavity defined by the rolled strip. When the pour is finished, the coupling member can be pulled from the strip for removal of the strip, if desired.

In some embodiments, a pier pad form comprises a flexible elongate body having a pair of opposing edges, a front surface, and a back surface. The front and back surfaces extend between the pair of opposing edges. A foldable portion is configured to receive a coupling member. A slot is positioned along the elongate body such that, when the foldable portion extends through the slot, the elongate body forms a cavity having a shape corresponding to a shape of a pier pad.

In some embodiments, the foldable portion is a foldable tab having a throughhole sized to receive the coupling member. In some embodiments, the foldable portion comprises a pair of selectively movable tabs positioned near corners located at one end of the elongated body. In some embodiments, the foldable portion comprises an upper tab and a lower tab spaced from the upper tab. The slot comprises an upper row of slots and a lower row of slots spaced from the upper row of slots such that the upper and lower tabs are configured to extend through one of the slots of the upper row and one of the slots of the lower row, respectively. In some embodiments, the foldable portion is configured to removably receive the coupling member.

In some embodiments, a pier pad form comprises a flexible elongate body having a first end, a second end opposing the first end, a front surface, and a back surface. The front surface and back surface extend between the first end and the second end. A first pair of slots is positioned along the first end. A second pair of slots is positioned along the second end. The first pair of slots is configured to mate with the second pair of slots such that an elongated coupling member can be passed through both the first and second pair of slots. In some embodiments, the form has a plurality of pairs of closed ended slots interposed between the first pair of slots and the second pair of slots.

In some embodiments, a pier pad form comprises a flexible elongate body having a first end, a second end opposing the first end, a front surface, and a back surface. The front and back surfaces extend between the first end and the second end. An array of slots is disposed in the elongate body. The array of slots comprises a first pair of slots positioned at the first end and a second pair of slots such that the first pair and second pair of slots are aligned when the first end overlays the second end.

In some embodiments, when the first end overlays the second end, the elongate body is configured to receive and hold a rigid coupling member within the first and second pairs of slots. In some embodiments, the first pair of slots is configured to mate with the second pair of slots such that an elongated coupling member can be passed through both the first pair of slots and the second pair of slots.

In other embodiments, a pier pad form comprises a flexible elongate body and means for coupling. The flexible elongate body has a first end, a second end opposing the first end, a front surface, and a back surface. The front surface and back surface extend between the first end and the second end. The means couples one of the first and second ends to the flexible elongate body to form a mold cavity corresponding to a shape of a pier pad. In some embodiments, the means for coupling includes a means for fastening that extends through the means for coupling.

In some embodiments, a method of forming a pier pad comprises positioning a first end of a flexible elongate form along a main body of the form. The main body extends between the first end and an opposing second end to define a molding cavity. The first end is coupled to the main body with a fastener. Moldable material is poured into the cavity. In some embodiments, coupling the first end to the main body comprises positioning a coupling member through folded portions of the first end. The folded portions extend through and from corresponding slots in the main body. In some embodiments, the positioning of the first end is determined using a table relating pier pads of a first shape to pier pads of a second shape. In some embodiments, the table list conversions between square pier pads and circular pier pads.

BRIEF DESCRIPTION OF THE SEVERAL VIEWS OF THE DRAWINGS

In the drawings, identical reference numbers identify similar elements or acts. The sizes and relative positions of elements in the drawings are not necessarily drawn to scale.

FIGS. 11A-11B are tables used to assemble form assemblies.

DETAILED DESCRIPTION OF THE DISCLOSURE

Figure 1A:
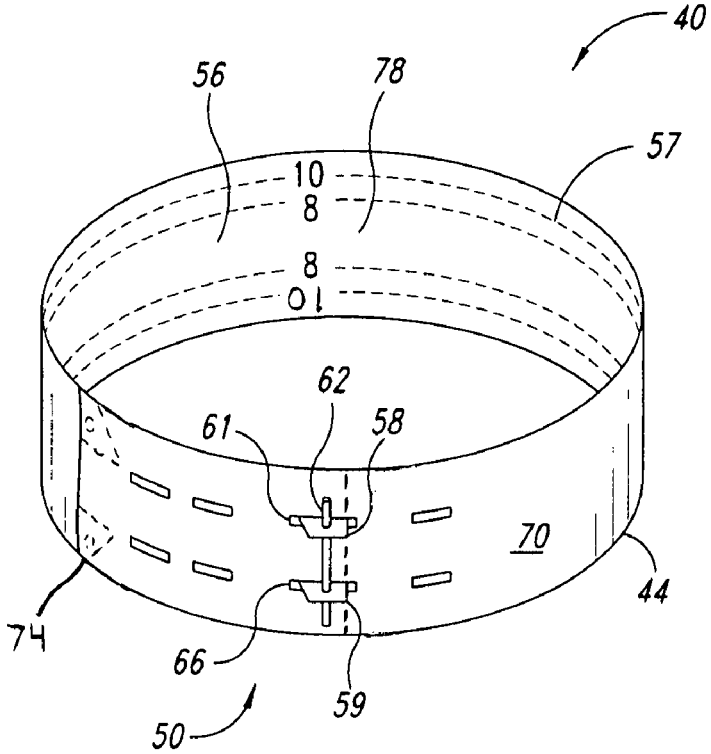
FIG. 1A is a perspective view of an embodiment of a form assembly ready to receive moldable material.

FIG. 1A shows an assembled form assembly 40 configured to receive moldable material. The illustrated form assembly 40 includes a flexible elongate form 44 and a locking assembly 50. The locking assembly 50 is used to size a cavity 56 defined by the rolled form 44. The illustrated cavity 56 is generally circular.

Figure 2:
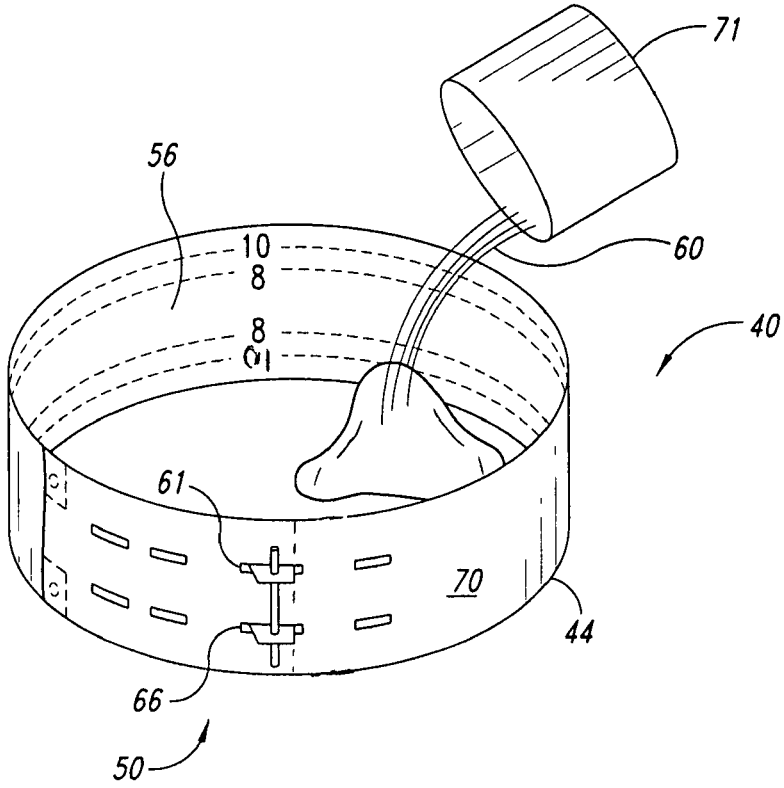
FIG. 2 is a perspective view of the form assembly of FIG. 1A, wherein moldable material is being poured into a cavity defined by a flexible form.
Figure 3:
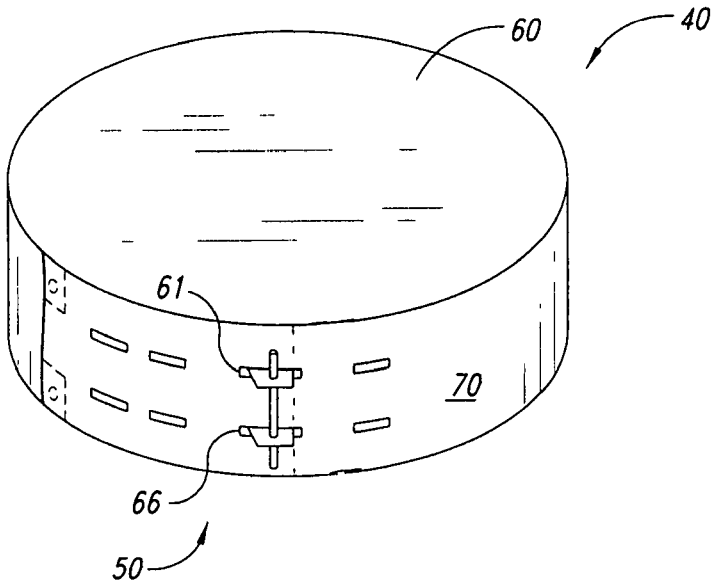
FIG. 3 is a perspective view of the form assembly of FIG. 1A after the moldable material has set.

As shown in FIG. 2, moldable material 60 can be poured from a container 71 into the cavity 56. After the cavity 56 is filled with a threshold about of material 60, the material 60 can be set, as shown in FIG. 3. As used herein, the term "moldable material" is a broad term and may include, but is not limited to, cement, such as fiber cement, mixtures of alumina silica, lime, iron oxide, and magnesium oxide, Portland cement, or other types of cements known in the art. In other embodiments, the moldable material can be a polymer, plastic, rubber, combinations thereof, or other suitable material that can be molded into a desired shape.

Figure 1B:
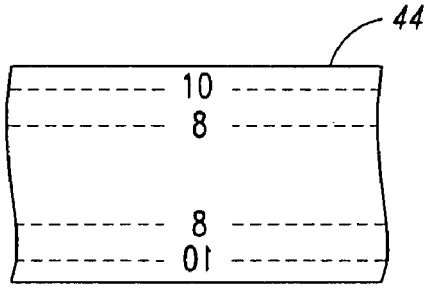
FIG. 1B is a side elevational view of an interior surface of the form assembly of FIG. 1A.

The form assembly 40 can have one or more indicia to assist an individual using the elongate form 44. As shown in FIGS. 1A and 1B, a plurality of vertically spaced indicia (illustrated as longitudinally extending dashed lines) can indicate the amount or level of moldable material in the form assembly 40. The indicia can be at certain locations corresponding to desired pour heights. For example, the uppermost indicium 57 is a pour line that indicates that the height of the pour is about 10 inches. The indicia can be lines (e.g., solid or dashed lines), markers, bands, or any other visually recognizable feature suitable for assisting an individual during use. The indicia can be labeled to further assist the user, as shown in FIGS. 1A and 1B. Other types of indicia can also be used, if needed or desired. The forms discussed below can likewise have indicia to help a user during operation.

In some embodiments, the form assembly 40 can be removed from the molded structure. The form assembly 40 may be reused any number of times to form a desired number of molded structures. Alternatively, the form assembly 40 can be left on the molded structure, for example, to serve as reinforcement. The form assembly 40 provides design flexibility and is easy to use.

With reference to FIG. 1A, the locking assembly 50 can be used to select the size of the cavity 56. To size the cavity 56, a user can position tabs 58, 59 within slots 61, 66, respectively. The slots 61, 66 can be selected from an array of slots 85 (see FIG. 4) formed along the elongate form 44. A removable coupling member 62 extends through the aligned tabs 58, 59. As such, the coupling member 62 keeps the tabs 58, 59 in the corresponding slots 61, 66, and prevents inadvertent unlocking of the locking assembly 50 during use. Additionally, the vertically oriented coupling member 62 can be driven into the ground to minimize, limit, or prevent movement of the form assembly 40.

Figure 4:
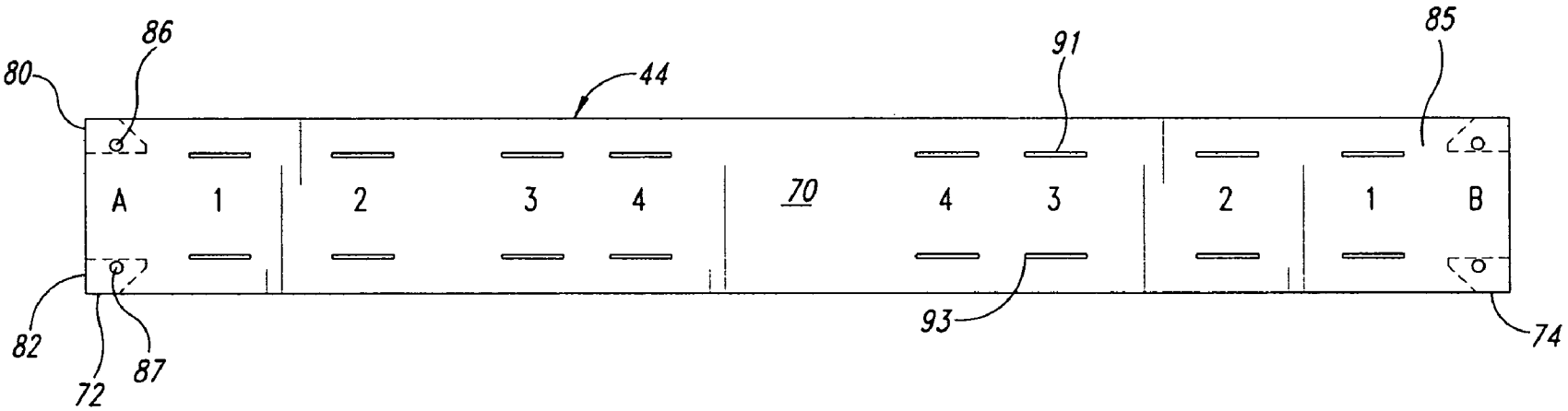
FIG. 4 is a front elevational view of an elongate form, in accordance with one embodiment.

With respect to FIGS. 1A and 4, the elongate form 44 includes a front surface 70, a back surface 78 opposing the front surface 70, and a pair of opposing ends 72, 74. The ends 72, 74 can be generally similar to each other and, accordingly, the following description of one of the ends applies equally to the other, unless indicated otherwise. Generally, the end 72 includes a pair of foldable portions 80, 82 positioned at or near the corners of the end 72. In some embodiments, only one end 72 may include the pair of foldable portions 80, 82. The foldable portions 80, 82 can be folded outwardly and inserted through one of the slots 85 in the elongate form 44. As noted above, each of the foldable portions 80, 82 can be configured to receive a portion of the coupling member 62. The illustrated portions 80, 82 each have a hole 86, 87 for receiving the coupling member 62.

With continued reference to FIG. 4, the array of slots 85 comprises an upper row of slots 91 and a lower row of slots 93. The rows of slots 91, 93 are oriented longitudinally along the length of the flexible form 44. Opposing slots of each row 91, 93 are generally laterally aligned such that the foldable portions 80, 82 can be easily inserted through each opposing pair of slots to form the cylindrical cavity 56.

The slots 85 can be elongated slots (illustrated as generally rectangular slots), circular slots, elliptical slots, or any other shaped apertures or holes suitable for receiving foldable portions. For example, the slots can be generally rectangular slots with a length of approximately 4"1/16" and a height of approximately ¼". The length of the elongate form 44 and the placement of the slots 85 can be selected based on the desired sizes of the cavity 56. As illustrated, the slots 85 are closed slots. Other types of slots can also be used.

Various types of materials can be used to form the elongate form 44. For example, the elongated form 44 can comprise polymers, plastics, metal cardboard, fibers (e.g., wood pulp), fillers, or combinations thereof. If the elongate form 44 is left on the molded pier pad for an extended period of time, the elongate form 44 can comprise mostly a non-biodegradable material, such as polypropylene, polyesters, and other non-biodegradable materials. In some embodiments, for example, the elongate form 44 can be made out of a sheet of corrugated polypropylene. In other embodiments, the elongate form 44 can be formed of a biodegradable material, such as cardboard. For a prolonged useful life, the form 44 can be formed of a moisture resistant material (e.g., polypropylene).

In some embodiments, the elongate form 44 can have one or more pre-formed fold lines. The elongate form 44 can be folded along the fold lines (see FIGS. 8 and 9) to form polygonal cross-sections. The elongate form 44 of FIG. 9 includes pour lines to assist in forming the pier. The form 44 can also be used to form other shapes.

The coupling member 62 of FIG. 1A can advantageously be a tool, building material, stake, anchor, or other device that is commonly found at construction sites. For example, a coupling member can be a tie bar, reinforcement bar, rebar, or other building material that is often used in construction. As such, commonly found items can be conveniently incorporated into the form assembly 40. In some embodiments, for example, anchors (e.g., mud sill anchors) can be easily slid through slots or holes in the elongate form 44. After the molding process, the coupling member can be removed and reused in another molding process after molding the pier pads. Alternatively, the coupling member can be incorporated into the structure being built.

Figure 5:
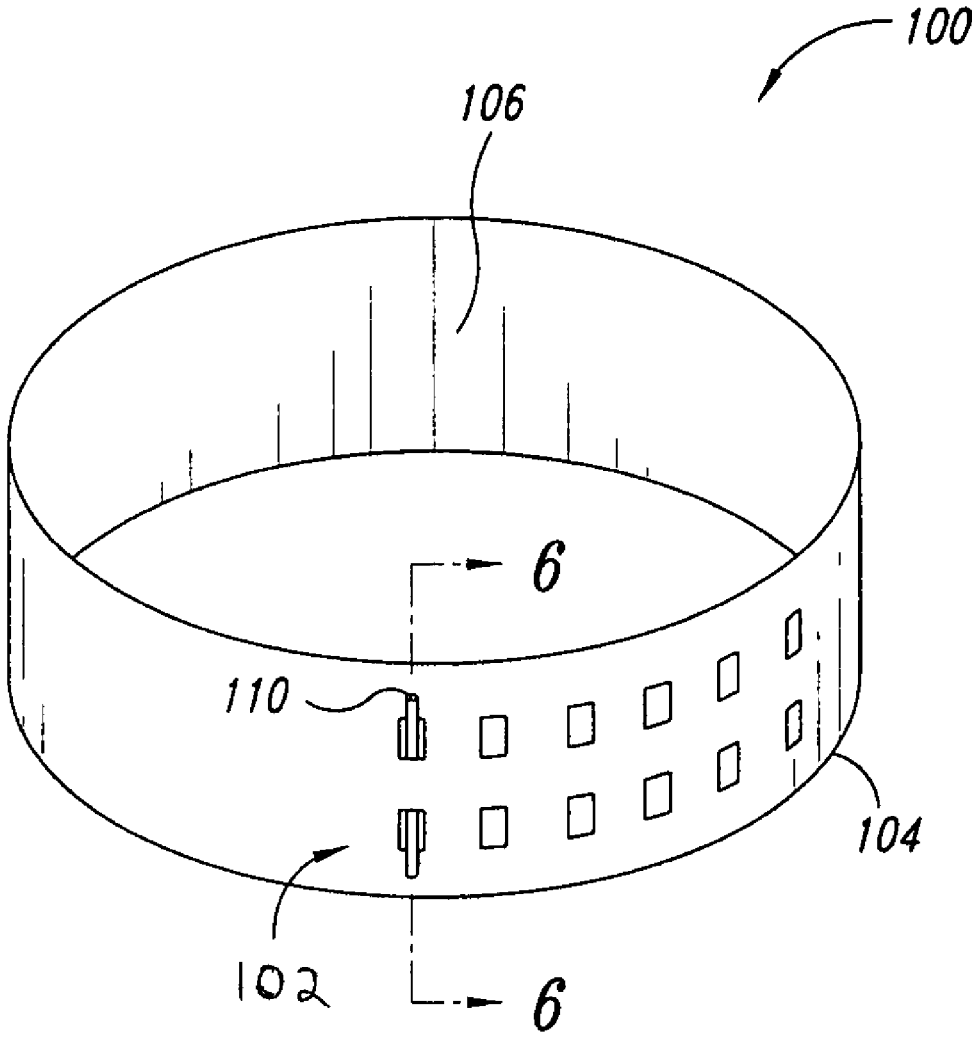
FIG. 5 is a perspective view of a form assembly ready to receive moldable material, in accordance with another embodiment.
Figure 6:
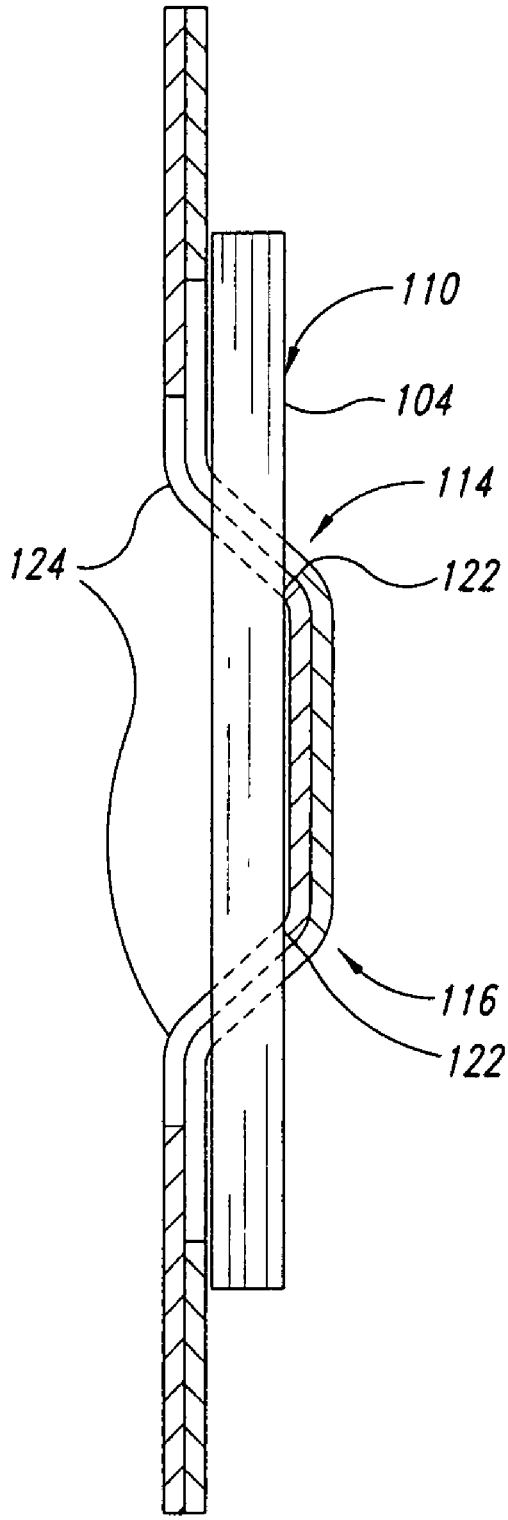
FIG. 6 is a cross-sectional view of the form assembly of FIG. 5 taken along line 6-6.

FIG. 5 shows an embodiment of a form assembly 100 that is generally similar to the form assembly 40 of FIG. 1A, except as detailed below. The illustrated form assembly 100 includes a locking assembly 102 comprising a coupling member 110 that extends through slots in an elongate form 104. As shown in FIG. 6, the coupling member 110 extends through an upper pair of slots 114 and a lower pair of slots 116. In this manner, two sections of the elongate member 104 can be temporarily or permanently coupled together to form a cavity having a desired configuration. In alternative embodiments, one of the pairs of slots can be replaced with an elongate slot. The coupling member 110 can pass through the single elongate slot and a pair of slots adjacent the elongate slot.

Figure 7:
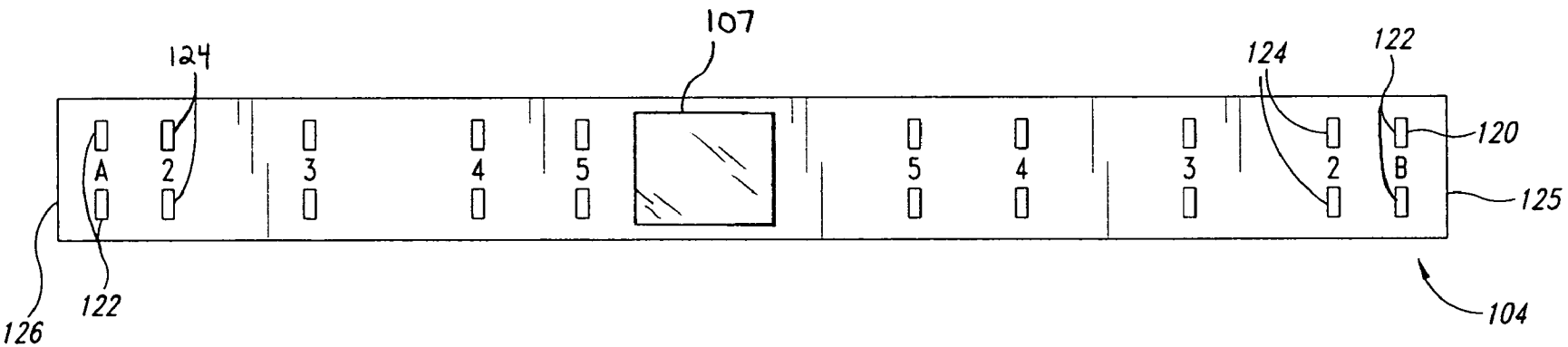
FIG. 7 is a front elevational view of an elongate form of the form assembly of FIG. 6.

With respect to FIG. 7, the elongate form 104 has an array of elongate slots 120. In the illustrated embodiment, the array of slots 120 comprises pairs of enlarged slots 122. An array of smaller slots 124 is interposed between the pairs of slots 122. In other embodiments, the slots 124 can be larger than or similar in size to the slots 122. Additionally or alternatively, when the form 104 is rolled up, the slots 124 can be misaligned with the slots 122. The position, size, and shape of the slots 122, 124 can be selected to achieve the desired interaction.

The coupling member 110 can be slid through the aligned slots 122, 124. Portions of the elongate form 104 between the pairs of slots 122, 124 can be positioned outwardly of the coupling member 110 such that the coupling member 110 is frictionally retained in the slots 122, 124, as shown in FIG. 6. To unroll the form 104, the coupling member 110 can be slid upwardly or downwardly out of the pairs of slots 122, 124.

Figure 8:
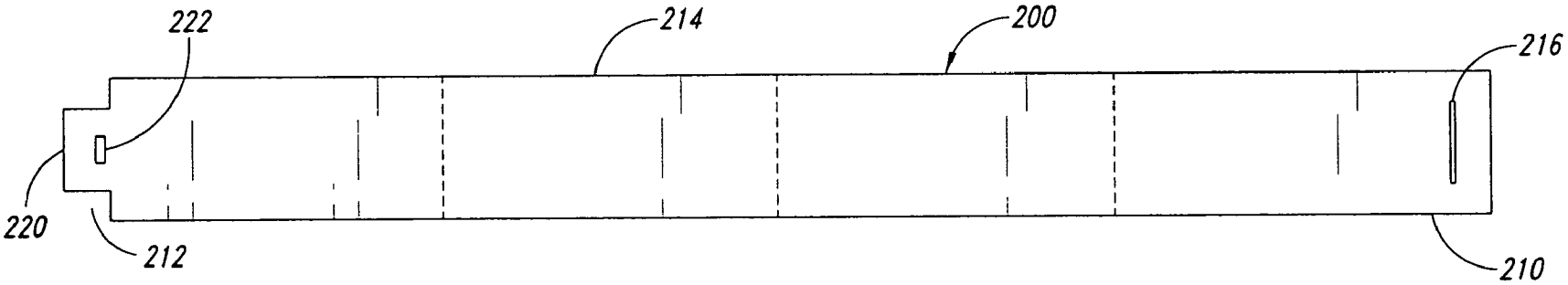
FIG. 8 is a front elevational view of a flexible form, in accordance with another embodiment.
Figure 9:
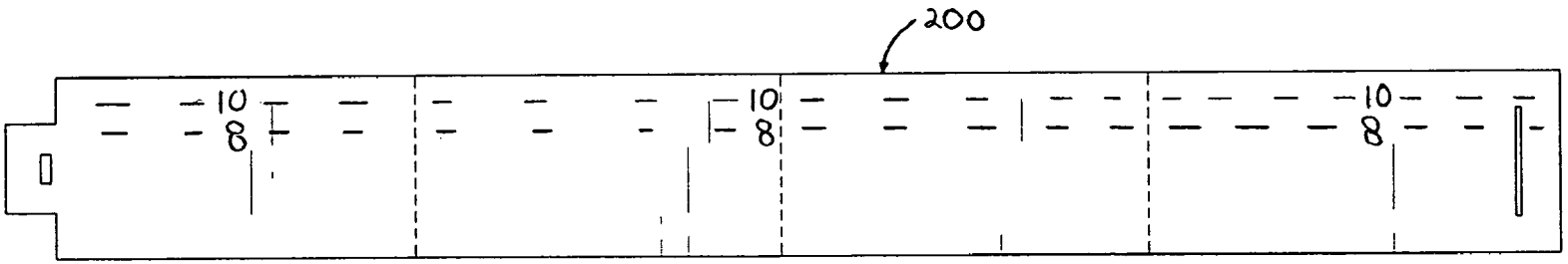
FIG. 9 is a front elevational view of an elongate form, in accordance with yet another embodiment.
Figure 10C:
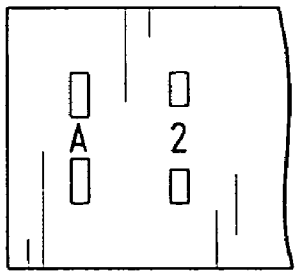
FIGS. 10A-F are front elevational views of ends of elongate forms, in accordance with some embodiments.
Figure 10F:
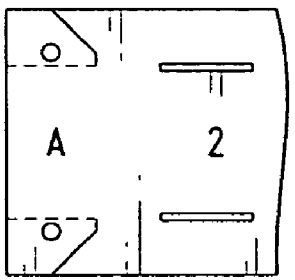
Figure 10B:
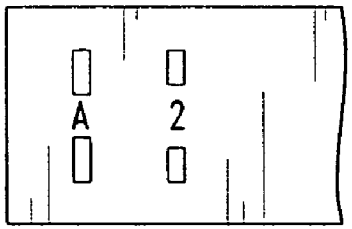
Figure 10E:
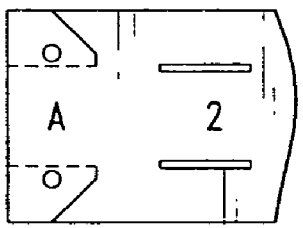
Figure 10A:
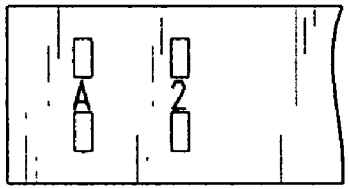
Figure 10D:
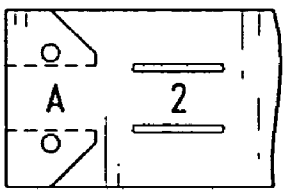

FIGS. 8 and 9 illustrate another embodiment of an elongate form that is generally similar to the elongate form 44 described above, except as detailed below. The illustrated embodiment may be particularly useful for forming polygonal (e.g., square or rectangular) pier pads. The illustrated elongate form 200 of FIG. 8 includes a slotted end 210, tab 212, and main body 214 extending therebetween. The slotted end 210 includes a slot 216 configured to receive the tab 212. To assemble the form assembly, the tab 212 can be inserted and advanced through the slot 216. Once positioned, a coupling member can be placed within a slot 222 positioned along the tab 212. In this manner, the elongate form 200 can be coupled together.

In use, a user can determine the desired size and shape of the structure to be formed. The user can then select the slots corresponding to the appropriately sized cavity. The pair of foldable portions 80, 82 are then inserted into the slots so that the bent elongate form 44 defines the cavity 56 having the desired cross-section. The length L between the foldable portions 80, 82 and the slots 85 can be selected based on the desired cross-sectional area of the cavity 56 using the formula:

$$L=\sqrt{4(\pi)(\text{Area})}$$

The above formula is for the elongate form 44 which forms a generally circular cavity 56. For example, to mold a cylindrical pier pad with a cross-sectional area of 100 $in^2$, the length L is about 35 inches. A table or chart can relate the lengths L to different cross-sectional areas typically used in construction. The table can be on the elongate form 44, a package insert, packaging, or the like for convenient access. Thus, a user can quickly determine how to assemble the form assembly 40 for an appropriately sized molding cavity 56. FIGS. 11A and 11B are example tables on the elongate form 104 that can be used to select the appropriate slots of the forms. The forms illustrated in FIGS. 1-7 and 10A-10F can have indicia (e.g., embossed, printed, or stamped indicia). For example, letters (e.g., A and B), numbers (e.g., 1, 2, 3, 4, and/or 5), or other indicia can be positioned along the form assemblies. FIGS. 11A and 11B depict an instruction sheet 107 on the elongate form 104. (See FIG. 7) The instruction sheet 107 includes tables used convert square configurations to circular configurations. For example, if a specification requires a square pier pad having a length and width of 18 inches (thus having an area of 324 $in^2$), user can couple section A or B to section 3 to form a circular cavity with a cross-sectional area of 324 $in^2$ corresponding to line 4 of FIG. 11B. Forms can be coupled together to form larger pier pads. Other tables can be generated to convert between various shapes.

In some embodiments, the necessary materials for constructing a pier pad are provided in a kit. The kit can comprise the form 44 and may or may not have moldable material, such as cement. The kit can include instructions which may indicate how to assemble the form assembly 40 to obtain cavities of different sizes. In some embodiments, the instructions can have a table or chart indicating which slots can be used to mold pier pads of different sizes.

Figure 12:
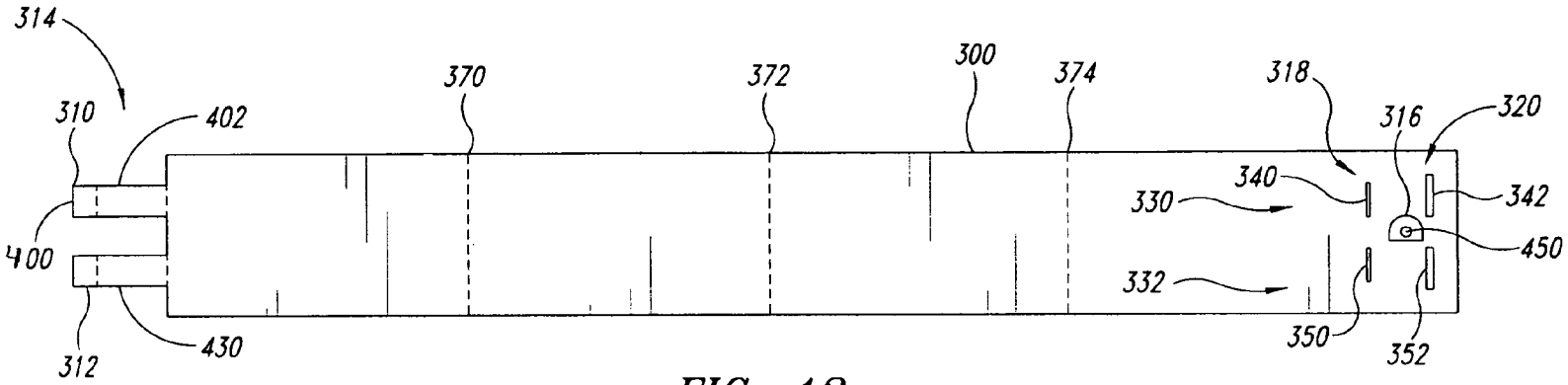
FIG. 12 is a side elevational view of a flexible form suitable for forming a generally square cavity, in accordance with some embodiments.

FIG. 12 shows an elongate form 300 having a plurality of insertable strips 310, 312 at one end 314 and both a deployable tab 316 and a perforated section 318 at the other end 320. Each of the insertable strips 310, 312 can be passed though an upper pair of longitudinally spaced slots 330 and a lower pair of longitudinally spaced slots 332, respectively. The pair of slots 330 includes a first upper vertical slot 340 and a second upper vertical slot 342. The pair of slots 332 includes a first vertical slot 350 and a second vertical slot 352. Other types of slotted arrangements can also be employed.

Figure 14:
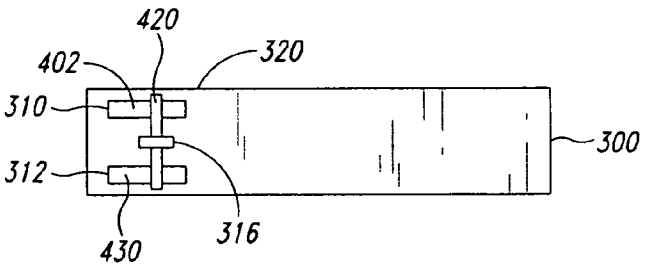
FIG. 14 is a side elevational view of the form assembly of FIG. 13.
Figure 13:
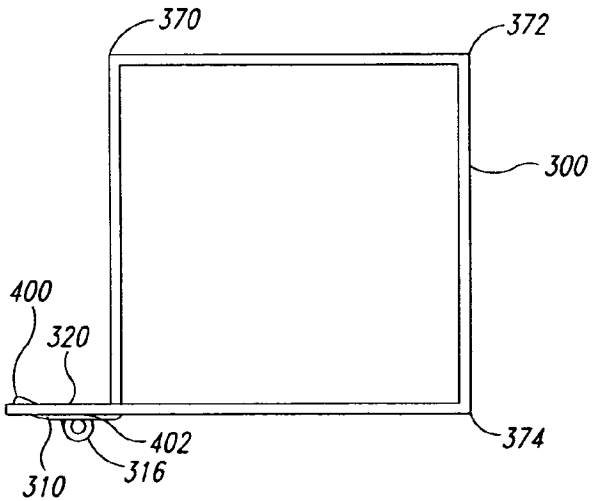
FIG. 13 is a plan view of a form assembly, the form assembly including a coupling member and the flexible form of FIG. 12.

FIGS. 13 and 14 show the elongate form 300 folded along three crush or fold lines 370, 372, 374 to form a generally square cavity. A tip 400 (see FIG. 12) of the insertable strip 310 is positioned on one side of the end 320 of the form 300, and a central section 402 of the insertable strip 310 is positioned on the other side of the end 320. Similarly, the insertable strip 312 can extend through the slots 350, 352.

Figure 15:
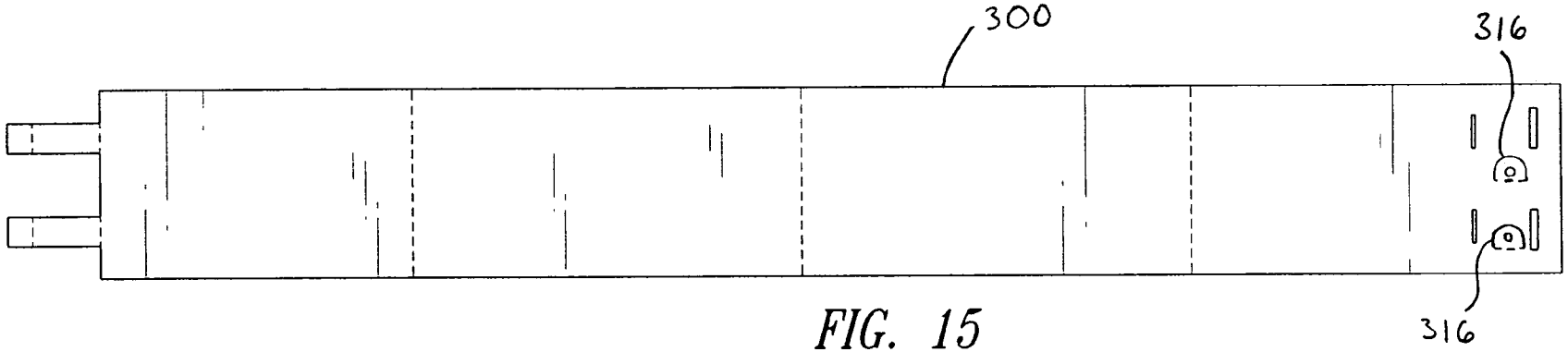
FIG. 15 is a side elevational view of a flexible form suitable for forming a generally square cavity, in accordance with some embodiments.

The tab 316 can extend outwardly in order to receive a coupling member 420 (illustrated as a rod). The central sections 402, 430 of the insertable strips 310, 312 are sandwiched between the coupling member 420 and the end 320 of the form 300. In some embodiments, the insertable strips 310, 312 bias away from the end 320 towards the coupling member 420. In this manner, the coupling member 420 can be pressed outwardly against the circumference of the aperture 450 (see FIG. 12) of the tab 316. FIG. 15 illustrates an elongate form 300 including a plurality of tabs 316.

Figure 16:
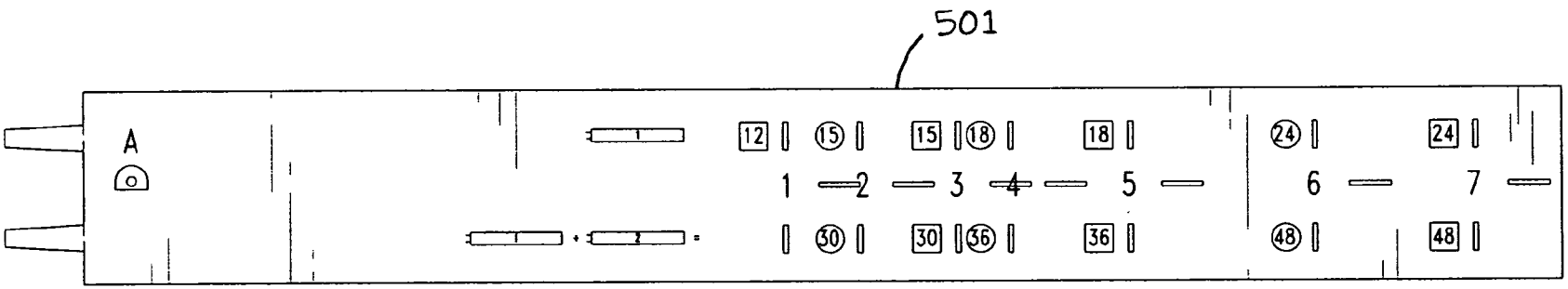
FIG. 16 is a side elevational view of a flexible form suitable for forming a generally circular cavity, in accordance with some embodiments.

Tables 18A and 18B below include dimensions and cost savings between at least some of the form assemblies disclosed herein in comparison to conventional cardboard forms. These tables can be used to size the elongate form 501 of FIG. 16.

TABLE 18A

| | | | | AREA SQ. | VOLUME CUBIC FT. | | | PIERS PER CUBIC YD. | | | CONCRETE $ SAVED PER PIER @ $60.00 PER CUBIC YARD | | |
|---|---|---|---|---|---|---|---|---|---|---|---|---|---|
| SIZE | MATRIX | CIR. | DIA. | FT. | 8" | 10" | 12" | 8" | 10" | 12" | 8" | 10" | 12" |
| 12 | A-1 | 42 9/16" | 13 9/16" | 1 | 0.6666 | 0.833 | 1 | 40.5 | 32.4 | 27 | $2.81# | $3.46# | $4.15# |
| 1 - | A-2 | 47 1/8" | 15" | 1.227 | .818 | 1.023 | 1.227 | 33 | 26.4 | 22 | $2.47# | $3.04# | $3.64# |
| 15 | A-3 | 53 3/16" | 16 15/16" | 1.5625 | 1.0416 | 1.302 | 1.5625 | 25.92 | 20.74 | 17.28 | $1.98# | $2.42# | $2.90# |
| 1 | A-4 | 56 9/16" | 18" | 1.767 | 1.178 | 1.473 | 1.767 | 22.9 | 18.3 | 15.28 | $1.67# | $2.03# | $2.44# |
| 18 | A-5 | 63 13/16" | 20 5/16" | 2.25 | 1.5 | 1.875 | 2.25 | 18 | 14.4 | 12 | $0.96# | $1.14# | $1.37# |
| 2 | A-6 | 75 7/16" | 24" | 3.1416 | 2.0943 | 2.618 | 3.1416 | 12.89 | 10.3 | 8.6 | $2.90 ☆ | $3.59 ☆ | $4.34 ☆ |
| 24 | A-7 | 85 1/8" | 27 1/8" | 4 | 2.666 | 3.333 | 4 | 10.1 | 8.1 | 6.75 | $1.61 ☆ | $2.01 ☆ | $2.43 ☆ |
| 3 - | *A2 + A2 | 94 1/4" | 30" | 4.908 | 3.27 | 4.09 | 4.908 | 8.25 | 6.6 | 5.5 | $4.52 ▲ | $5.65 ▲ | $6.79 ▲ |
| 30 | *A3 + A3 | 106 3/8" | 33 7/8" | 6.25 | 4.166 | 5.208 | 6.25 | 6.48 | 5.18 | 4.32 | $2.53 ▲ | $3.16 ▲ | $3.81 ▲ |
| 3 | *A4 + A4 | 113 1/8" | 36" | 7.068 | 4.71 | 5.89 | 7.068 | 5.73 | 4.58 | 3.82 | $6.53 ❖ | $8.12 ❖ | $9.76 ❖ |
| 36 | *A5 + A5 | 127 5/8" | 40 5/8" | 9 | 6 | 7.5 | 9 | 4.5 | 3.6 | 3 | $3.67 ❖ | $4.56 ❖ | $5.47 ❖ |

TABLE 18A-continued

| SIZE | MATRIX | CIR. | DIA. | AREA SQ. FT. | VOLUME CUBIC FT. 8" | 10" | 12" | PIERS PER CUBIC YD. 8" | 10" | 12" | CONCRETE $ SAVED PER PIER @ $60.00 PER CUBIC YARD 8" | 10" | 12" |
|---|---|---|---|---|---|---|---|---|---|---|---|---|---|
| ● 4 | *A4 + A6 | 131 15/16" | 42" | 9.62 | 6.41 | 8.01 | 9.62 | 4.2 | 3.37 | 2.81 | | Not available | |
| ■ 42 | *A5 + A7 | 148 15/16" | 47 7/6" | 12.25 | 8.166 | 10.2 | 12.25 | 3.3 | 2.64 | 2.2 | | | |
| ● 48 | *A6 + A6 | 150 13/16" | 48" | 12.56 | 8.377 | 10.47 | 12.56 | 3.2 | 2.58 | 2.15 | | | |
| ■ 48 | *A7 + A7 | 170 3/6" | 54 3/16" | 16 | 10.66 | 13.33 | 16 | 2.53 | 2.025 | 1.6875 | | | |

●/DIA. = Diameter
■ = Square
*= two pier strips
CIR. = Circumference
AREA SQ. FT. = Displacement

TABLE 18B

Pier Mold Box Method or Plastic Gone Round

PER./CIR. = Perimeter/Circumference

| SQ = Square SIZE | TYPE | PER./ CIR. | DIA. | AREA SQ. FT. | VOLUME CUBIC FT. 8" | 10" | 12" | PIERS PER CUBIC YD. 8" | 10" | 12" |
|---|---|---|---|---|---|---|---|---|---|---|
| #18 SQ | Paper/Plastic | 72" | 22 15/16 | 2.864 | 1.91 | 2.387 | 2.864 | 14 | 11.3 | 9.42 |
| ☆24 SQ | Paper/Plastic | 96" | 30 9/16 | 5.093 | 3.395 | 4.24 | 5.093 | 7.95 | 6.37 | 5.3 |
| ▲30 SQ | Plastic | 120" | 38 3/16 | 7.96 | 5.305 | 6.63 | 7.96 | 5.09 | 4.07 | 3.39 |
| ❖36 SQ | Plastic | 144" | 45 13/16 | 11.46 | 7.64 | 9.55 | 11.46 | 3.53 | 2.827 | 2.356 |

☆ ▲ ❖= PIER PADS AVAILABLE AND COMPARABLE TO SIZES USED

If a molded structure (e.g., a pier) with a load bearing area of 324 $in^2$ is desired, a user may select a conventional square shaped cardboard form with sides that are 18 in length. When the cement is deposited into the square cavity having an area of 324 $in^2$, the form may assume a circular shape resulting in circular cavity with an area of about 412 $in^2$, resulting in excess moldable material being used, which increases the overall production cost. The forms disclosed herein can be designed to maintain their shape to produce structures (e.g., piers, pier pads, etc.) with a desired shape to reduce, limit, or substantially eliminate unwanted excess material. For example, the form assemblies with circular cavities can maintain their shape before, after, and during the molding process.

Figure 17:
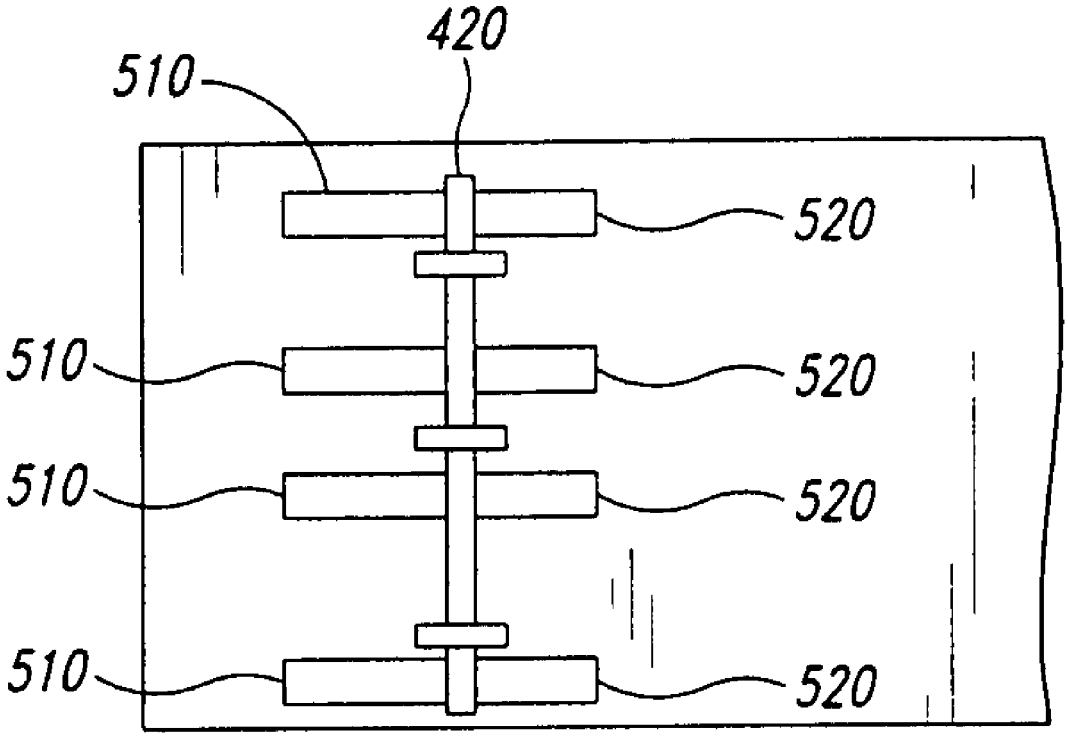
FIG. 17 is a side elevational view of a portion of a flexible form, in accordance with some embodiments.

The forms disclosed herein can have any number of slots, insertable strips, and tabs. FIG. 17 illustrates a section of an assembled form 500 having a plurality of insertable strips, a plurality of deployable tabs, and a plurality of vertically spaced sets of slots. The illustrated assembled form 500 includes four insertable strips 510 and three deployable tabs 512. The tabs 512 are interposed between a corresponding adjacent pair of insertable strips 510.

The articles disclosed herein may be formed through any suitable means. For example, forms can be formed through a die stamping process, cutting process, or other suitable method of manufacturing. The various methods and techniques described above provide a number of ways to carryout the invention. Of course, it is to be understood that not necessarily any or all objectives or advantages described may be achieved in accordance with any particular embodiment described herein. Thus, for example, those skilled in the art will recognize that the methods may be performed in a manner that achieves or optimizes one advantage or group of advantages as taught herein without necessarily achieving other objectives or advantages as may be taught or suggested herein.

Furthermore, the skilled artisan will recognize the interchangeability of various features from different embodiments disclosed herein. Similarly, the various features and steps discussed above, as well as other known equivalents for each such feature or step, can be mixed and matched by one of ordinary skill in this art to perform methods in accordance with principles described herein. Additionally, the methods which are described and illustrated herein are not limited to the exact sequence of acts described, nor are they necessarily limited to the practice of all of the acts set forth. Other sequences of events or acts, or less than all of the events, or simultaneous occurrence of the events, may be utilized in practicing the embodiments of the invention.

Although the invention has been disclosed in the context of certain embodiments and examples, it will be understood by those skilled in the art that the invention extends beyond the specifically disclosed embodiments to other alternative embodiments and/or uses and obvious modifications and equivalents thereof. Accordingly, the invention is not intended to be limited by the specific disclosures of preferred embodiments herein.

What is claimed is:

1. A system comprising:

a pier pad form, including a flexible elongate body having a pair of opposing edges, a front surface, a back surface, and a strip, the front and back surfaces extending between the pair of opposing edges, the elongate body having a length and height such that the elongate body defines a cavity for receiving cement poured into the cavity so as to form a pier pad for supporting a structural column, the cavity having a shape corresponding to a shape of the pier pad;

a foldable tab including a throughhole configured to receive a coupling member; and a slot positioned along the elongate body such that, when the foldable tab extends through the slot and the coupling member extends through the throughhole, the elongate body defines the cavity and the strip is sandwiched between the coupling member in the throughhole and a portion of the flexible elongate body.

2. The system of claim 1, further comprising a pair of selectively movable tabs positioned near corners located at one end of the elongated body.

3. The system of claim 1, further comprising an upper tab and a lower tab spaced from the upper tab, the slot comprises an upper row of slots and a lower row of slots spaced from the upper row of slots such that the upper and lower tabs are configured to extend through one of the slots of the upper row and one of the slots of the lower row, respectively.

4. The system of claim 1 wherein the foldable tab is configured to removably receive the coupling member.

5. A pier pad form comprising:

a flexible elongate body having a first end, a second end opposing the first end, a front surface, and a back surface, the front surface and back surface extending between the first end and the second end; and means for coupling one of the first and second ends to the flexible elongate body to form a mold cavity corresponding to a shape of a pier pad, the means for coupling including an elongate coupling member and a foldable tab of the flexible elongate body, the foldable tab including an aperture configured to receive the elongate coupling member when the foldable tab extends through a slot of the flexible elongate body to hold the first end between the flexible elongate body and the elongate coupling member.

6. The pier pad form of claim 5, wherein the means for coupling includes a means for fastening that extends through the means for coupling.

7. The system of claim 1, wherein a plurality of strips extend outwardly from an edge of the flexible elongate body.

8. The system of claim 1, further comprising:

a plurality of indicia on the flexible elongate body, the plurality of indicia corresponding to a plurality of pour heights.

9. The system of claim 1, further comprising:

another strip extending from one of the edges, each of the strips being configured to pass through a respective slot in the flexible elongate body to sandwich the respective strip between the flexible elongate body and the coupling member extending through the foldable tab.

10. The pier pad form of claim 5, wherein the means for coupling includes a plurality of strips connected to the flexible elongate body and insertable through respective slots in the flexible elongate body.

11. The system of claim 1, further comprising a coupling member holding the strip against the elongate body when the foldable tab is positioned between the strip and another strip of the elongate body and the foldable tab receives the coupling member.

12. A pier pad form comprising:

a flexible elongate body for defining a cavity corresponding to a shape of a pier pad, the elongate body including a plurality of slots;

a foldable portion configured to receive a coupling member; and a plurality of strips connected to the elongate body, the strips defining a space through which the foldable portion extends when the flexible elongate body forms the cavity and the strips are positioned between a coupling member received by the foldable portion and the elongated body, each of the strips is configured to pass through a respective one of the slots so as to sandwich the respective strip between a portion of the elongate body and the coupling member positioned in the foldable portion when the foldable portion extends through the elongate body.

13. The pier pad form of claim 12, wherein the elongate body includes a first end and a second end opposing the first end, the strips are connected to the second end, and the first end is between the strips and the second end when the strips pass through slots at the first end and the strips are in folded back positions.

14. The pier pad form of claim 12, further comprising:

a plurality of indicia on the flexible elongate body, the plurality of indicia corresponding to a plurality of pour heights.

15. The pier pad form of claim 12, further comprising a coupling member that extends across the strips when the strips extend through the slots in the elongate body and along an exterior surface of the elongate body.

16. The pier pad form of claim 15, wherein the foldable portion is a tab with a throughhole dimensioned to receive the coupling member.

17. The system of claim 1, further comprising:

a coupling member sized to pass through the foldable tab to hold the foldable tab in the slot.

18. The pier pad form of claim 12, further comprising:

cement held in the cavity defined by the flexible elongate body.

19. The system of claim 1, wherein the foldable tab is configured to hold the coupling member in a substantially vertical orientation such that the coupling member extends across a width of the strip.

20. The pier pad form of claim 12, wherein the foldable portion is configured to extend through a portion of flexible elongate body away from the cavity such that the coupling member received by the foldable portion is positioned outside the cavity and extends across the plurality of strips.

* * * * *